US011145282B2

(12) United States Patent
Tzeng et al.

(10) Patent No.: US 11,145,282 B2
(45) Date of Patent: Oct. 12, 2021

(54) WOODWIND MOUTHPIECE

(71) Applicant: Mien-Huei Tzeng, Tainan (TW)

(72) Inventors: Yon-Hua Tzeng, Tainan (TW); Mien-Huei Tzeng, Tainan (TW)

(73) Assignee: Mien-Huei Tzeng, Tainan (TW)

( * ) Notice: Subject to any disclaimer, the term of this patent is extended or adjusted under 35 U.S.C. 154(b) by 0 days.

(21) Appl. No.: 17/126,081

(22) Filed: Dec. 18, 2020

(65) Prior Publication Data

US 2021/0193090 A1 Jun. 24, 2021

Related U.S. Application Data

(60) Provisional application No. 62/950,982, filed on Dec. 20, 2019.

(51) Int. Cl.
*G10D 9/035* (2020.01)
*G10D 9/08* (2020.01)

(52) U.S. Cl.
CPC ..... *G10D 9/035* (2020.02); *G10D 9/08* (2020.02)

(58) Field of Classification Search
CPC ..... G10D 9/035; G10D 3/00; G10D 9/08
See application file for complete search history.

(56) References Cited

U.S. PATENT DOCUMENTS

2019/0005926 A1* 1/2019 Mure ..... G10D 9/035

* cited by examiner

*Primary Examiner* — Kimberly R Lockett
(74) *Attorney, Agent, or Firm* — Bacon & Thomas, PLLC

(57) ABSTRACT

The present invention relates to a novel woodwind mouthpiece, which comprises: a main body having an elongated streamlined shape; a hollow chamber and a bore inside the main body; a reed table on one side of the main body and partially suspended from the main body; a beak on an opposite side to the reed table on the main body; a reed rail surrounding the beak and connecting to two lateral sides of the reed table to form an opening window between a reed and the hollow chamber inside the main body; and a tip opening disposed between the reed rail at a tip of the beak and an virtual surface extending from a surface of the reed table, wherein the woodwind mouthpiece is made of a plastic, a metal, an alloy, a composite, wood or a combination thereof.

14 Claims, 11 Drawing Sheets

WOODWIND MOUTHPIECE

CROSS REFERENCE TO RELATED APPLICATION

This application claims the benefit of filing date of U.S. Provisional Application Ser. No. 62/950,982 filed Dec. 20, 2020 under 35 USC § 119(e)(1).

BACKGROUND

1. Field

The present invention relates to a woodwind mouthpiece. More specifically, the present invention relates to a high-performance woodwind mouthpiece.

2. Description of Related Art

Woodwind musical instruments such as saxophone and clarinet are popular around the world and have enriched the quality of humanity for more than 100 years. Saxophone, clarinet and their derivatives use one single reed made of various materials ranging from cane, bamboo, wood, composite materials, metal to plastic. The reed is held onto a table on a mouthpiece to allow it to vibrate under the influence of air, which is blown by a player into the mouthpiece, and the integrated resonant cavities including the player's mouth, the mouthpiece and the musical instrument. The reed is commonly held by a ligature to a table, which is an integrated part of a mouthpiece. Ligature relies on a specially designed structure with different shapes and weight to fix and tighten the reed to the table.

Ligature is usually mounted in such ways that it surrounds the main body of a mouthpiece. The inner surface of ligature matches the outer surface of the mouthpiece main body after the bolt tightens together the ligature and the reed with the mouthpiece. The all-around ligature structure often scratches the mouthpiece main body and affects adversely on the appealing profile. Traditional ligature has a ring shape structure, of which the inner diameter changes gradually from one end to the other end and only slightly.

Some mouthpiece has groves cut into both sides of the mouthpiece to allow ligature to slide in and to hold on to the edges of the groves instead of surrounding the mouthpiece main body. A threaded bolt is adjusted to fix and tighten a reed inserted between the slide-in ligature and the table of the mouthpiece to the table. In order to turn the bolt by hand easily, the bolt is large in diameter. The ligature is usually large, cumbersome and affects adversely the appearance of a mouthpiece.

Some ligature has solid ring shape structure, which by means of an elastic structure between the ring ligature and the surface of mouthpiece to hold the reed against the table when the ring is pushed from small diameter part of the mouthpiece towards a slightly larger diameter part of the mouthpiece. Like most traditional ligature, ring shape ligature surrounds a mouthpiece. Therefore, ring-shape ligature suffers from the same strict requirement of matching its inner surface with the exterior surface of mouthpiece.

Besides the table where a reed is mounted, a saxophone mouthpiece includes a tip rail and two side rails. These side rails set a limit to how much a reed may bend both parallelly and perpendicularly to the main body of a mouthpiece when it vibrates. The reed, the rails, the table, and the remaining body of a mouthpiece enclose a resonant cavity inside a mouthpiece when the reed touches the rails and seals air from entering or leaking from the internal cavity of a mouthpiece. At this moment, the air pressure inside the cavity is lower than the pressure inside a player's mouth. The air pressure inside a mouthpiece oscillates in resonance to the integrated air cavity including the player's mouth, the mouthpiece and the internal dimensions of a saxophone. The elastic force of the bent reed and the rising air pressure inside the mouthpiece push the reed away from the rails to restore its position at rest and then bend farther away from the rails. The reverse actions follow and the reed restores to its position at rest again and then bends towards the rails driven by the difference between the higher air pressure inside the mouth of a player and the lower air pressure inside the mouthpiece cavity. The bending of the reed repeats at a frequency, which is determined by the embouchure of a player and the dimensions of the air cavity of the mouthpiece and the main body of a saxophone. The mouthpiece tip serves as the equivalence of a closed end of an air cavity of the mouthpiece. The open tone hole or multiple tone holes nearest to the mouthpiece serve as an open end of the air cavity. The overall dimensions of the air cavity determine the fundamental resonance frequency of oscillation of air pressure and the sound it generates.

Inside a mouthpiece, the profile and dimensions of the air-flow channel determine the velocity distribution of the air flowing from the mouthpiece to the main body of the saxophone. Air is blown into the mouthpiece by a player from the tip opening through the beak, the chamber of the mouthpiece to the bore and then to the remaining main body of the saxophone until it reaches an open tone hole or multiple tone holes. The air-flow channel inside a mouthpiece includes, from the tip opening between the tip rail and the reed at the front end of the beak of the mouthpiece to the end of the mouthpiece, into which the neck of a saxophone is inserted. The tip opening determines how far a reed is allowed to bend before it stops at the surface of the tip rail. For the same reed, the larger the tip opening is, the larger the force driven by pressure difference on opposite sides of the reed needs to be in order to bend the reed for it to touch the tip rail and side rails and seal more air from being blown into the mouthpiece cavity. The air pressure inside the mouthpiece reaches the minimum and the reed begins to reverse its bending.

The separation distance between the reed and the approximately parallel inner surface of the mouthpiece cavity increases from the tip to the chamber of a mouthpiece at different rates depending on the mouthpiece cavity design. The first part of the air channel is defined by the beak and the reed. A baffle is an option on the interior surface of the beak. High baffle means a smaller gap and air channel between the reed and the surface of a baffle. High baffle results in a small cross-sectional area of the air channel and a higher air flow speed for the same air flow throughput. Bright sound with long projection is produced because of a high-speed air jet entering a larger bore dimension from a high baffle and a small chamber. The effects of a low baffle and no-baffle on air speed and air flow are opposite to those of high baffle.

The air channel is then entering the bore of the mouthpiece. The inner diameter of the rear exit of a mouthpiece, i.e., the bore size, is set to match the outer diameter of the neck of the saxophone including a soft cork around the neck. The mouthpiece chamber can be larger, the same as, or smaller than the bore size. The ratio of the size of the chamber to that of the bore affects the tone color. A mouthpiece with a small chamber than the bore produces relatively bright sound. Large chamber mouthpiece produces relatively dark sound. Medium chamber mouthpiece produces sound between those of small and large chambers. A wide variety of internal geometry and dimensions of mouthpiece cavities were developed. The external structure of a mouthpiece affects not only its fashionable appearance but also the playability, tone color, body vibration and sound volume produced by a mouthpiece and a woodwind instrument. However, due to the restrictions by machining capability and the mechanical strength of materials for manufacturing a mouthpiece, the wall thickness of a mouthpiece including the beak, the rails, the chamber, the bore, the reed table and the mouthpiece body need to optimized.

The external surface of a mouthpiece near the tip forms the beak of the mouthpiece. The beak or a part of it is inserted into the mouth of a player. The lips of the player's mouth seal the air blown by the player, prevent air from leaking out, and force the air to enter the tip opening between the reed and the tip rail. The embouchure, which determines how a mouthpiece is held and interacted with the human cavity consisting of the player's mouth, the throat, and the lung is important. It affects the quality of sound being generated. Both the beak and the reed inside a player's mouth are very important to the performance of a mouthpiece. They affect the comfort and how much effort it takes for a player to control air flow inside a mouthpiece to produce desired sound. Besides the desirable tone color and being in tune, the first criterion for a good mouthpiece is its easy and effortless playability. When using a high-performance mouthpiece, a player feels comfortable and does not become tiresome in controlling the generation of sound even after a long playing period.

The prior art of mouthpiece designs is restricted by the manufacturing capability, costs, and materials suitable for the mouthpiece. Hand-crafting, Machining, injection molding, casting and laser trimming are among the common techniques of manufacturing woodwind mouthpieces. The state-of-the-art mouthpiece leaves much room for improvement in performance and easy playability. With advanced additive manufacturing science and technology making rapid progresses, some dimensions and novel structures which were difficult, impossible, or too expensive to manufacture become an open option.

SUMMARY

An object of the present invention is to provide a novel woodwind mouthpiece with improved performance and easier playability.

The woodwind mouthpiece of the present invention comprises: a main body having an elongated streamlined shape; a hollow chamber and a bore inside the main body; a reed table on one side of the main body and partially suspended from the main body; a beak on an opposite side to the reed table on the main body; a reed rail surrounding the beak and connecting to two lateral sides of the reed table to form an opening window between a reed and the hollow chamber inside the main body; and a tip opening disposed between the reed rail at a tip of the beak and an virtual surface extending from a surface of the reed table, wherein the woodwind mouthpiece is made of a plastic, a metal, an alloy, a composite, wood or a combination thereof.

In the woodwind mouthpiece of the present invention, a side of the reed table closest to the beak is attached to the main body, and another side of 10% to 90% of the total area of the reed table farthest from the tip of the beak is suspended from the main body to form a gap between the reed table and the main body.

In the woodwind mouthpiece of the present invention, the reed rail comprises a tip rail and side rails connecting to the tip rail, and a lay length is a distance between the tip rail and a break-point of one of the side rails. A front section of the beak equal to 80% of a distance between the tip rail and an interface along a central line in a longitudinal direction of the main body has a beak wall thickness (T1*a*) ranging from 0.5 mm to 2.5 mm, wherein the interface is between the beak and a connection portion connecting the beak and the main body. At the interface, the upper exterior surface near the border of the beak and the connection portion has the maximum curvature.

In the woodwind mouthpiece of the present invention, the beak comprises an upper exterior surface and a lower internal surface opposite to the upper exterior surface, wherein the lower internal surface is a lower surface of the side rail. An angle (θ1) between the upper exterior surface of the beak and a virtual plane starting from the tip of the beak to the interface between the beak and the connection portion on the side rails ranges from 0 degree to 20 degrees.

The woodwind mouthpiece of the present invention has the following novel features and exhibits better performance than traditional ones:

(1) It has a unique slender, thin, and small-angle beak for comfort and ease of play. Thanking to advanced materials and modern additive manufacturing techniques, the beak can be made so thin that it allows a player to adopt a more comfortable and tireless embouchure that is impossible by a traditional mouthpiece with a thick and large-angled beak. A player does not need to keep a mouth open so much to fit the thick beak of a traditional mouthpiece anymore.

(2) The slender, thin, and small-angle beak ends near the break-point of the side rails, from which the side rails extend from the reed table towards the tip of the beak and begin to separate from a flat reed fixed to the reed table to become a curved rail and produce a tip opening between the tip rail and the reed at the tip of the beak. The transition from small-angle region of a beak to the large-angle exterior surface of the section connecting the beak to the main body provides a natural alignment mark of the break-point for a player to adjust the optimal embouchure.

(3) It has a reed table that is partially suspending with respect to the main body and induces new vibrational modes of the table and a reed fixed to it and a broader range of sound harmonics. The seemingly unattached table not only accommodates a compact slide-in ligature but induces the reed on the reed table to vibrate in new modes which cannot be achieved by a traditional mouthpiece and resonate so much better than a traditional table that is tightly attached to the main body and cannot vibrate independently of the main body of a woodwind mouthpiece.

(4) The additional modes of vibration of the reed tightened to the reed table can be varied by selecting desired elasticity of the reed table.

(5) The additional modes of vibration of the reed can be varied by an additional structure made of materials of desired elasticity near the far end of the reed table from the beak between the reed table and the main body.

(6) The partially suspending reed table provides additional dimensional control over the tip opening formed between the tip rail and the tip of a reed mounted on the reed table by bending the reed table at a desired angle with respect to the main body.

With these features, many woodwind players will play it with ease and enjoy rich resonance that will fulfill their desires.

The dimensions and shape of the beak of a saxophone mouthpiece affect how best a player can optimize his/her embouchure, which in turn affects the comfort a player feels and whether a player feels tiresome after blowing and controlling a mouthpiece for a long period of time. It also affects the angle of air entry into the mouthpiece and how air is blown through the tip opening into the mouthpiece. The characteristics of sound that the mouthpiece generates are thus affected. Specifically, when a player holds a woodwind instrument in the same direction, the slope of the upper exterior surface of the beak affects the direction of air entry into the mouthpiece. When a reed on a table is at rest, the reed is in touch with both the table and the flat side rails surrounding the window in the farthest end from the tip of the beak. The reed begins to separate from the side rails at a position known as the break-point to form the curved part of side rails. The position of lower lip relative to the break-point affects the physical dimensions of the reed-based cantilever and thus the vibration resonance of the reed and sound quality of the mouthpiece. A thin, small-angle, flat upper exterior surface of a thin beak with the thin region of the beak ending near the break-points of the side rails provides more flexibility in the choice of the angle of the mouthpiece with respect to the head of a player as compared with traditional mouthpieces with a thick and large-angle beak. The lower lip of a player are more conveniently placed near the break-point of the side rails because the break-point is near where the small-angle beak begins transition to a large-angle connective section between the beak and the main body. The fast-increasing slope provides the player with a convenient physical alignment mechanism for a player to adjust the lips and teeth for better control of the mouthpiece and production of the desired sound. For a traditional mouthpiece with a large sloped beak, the beak increases in thickness and height from the tip beyond the break-point. It is difficult for a player, especially a beginner player, to position his/her lips and upper teeth at the optimal position of the beak, i.e., the best distance from tip of the beak. Therefore, it is more difficult for a player to play precisely and reproducibly. A player needs to make much more efforts to control the stability and reproducibility of the optimal embouchure.

In the woodwind mouthpiece of the present invention, the angle (θ1) included between the upper exterior surface and the lower surface of the side rails at the interface point can be ranged from 0 degree to 20 degrees, for example greater than 0 degrees but less than or equal to 20 degrees ($0° < \theta 1 \leq 20°$). Here, the angle can be measured from the tip of the beak to the interface of the side rails of the woodwind mouthpiece. Preferably, the angle (θ1) can be ranged from 0 degree to 15 degrees, for example greater than 0 degrees but less than or equal to 15 degrees ($0° < \theta 1 \leq 15°$).

In the woodwind mouthpiece of the present invention, the angle (θ1) included between the upper exterior surface and the lower surface of the side rails at the interface between the beak and the connection portion can be ranged from 2 degree to 20 degrees ($2° \leq \theta 1 \leq 20°$). Here, the angle can be measured from the tip of the beak to the interface of the woodwind mouthpiece. Preferably, the angle (θ1) can be ranged from 5 degree to 15 degrees ($5° \leq \theta 1 \leq 15°$). More preferably, the angle (θ1) can be ranged from 5 degree to 10 degrees ($5° \leq \theta 1 \leq 10°$).

The woodwind mouthpiece of the present invention has a small angle included between the upper exterior surface and the lower surface of the side rails at the interface, and in particular, the small-angle slope of the beak ends at a distance from the tip near the interface of the side rails. Thus, the woodwind mouthpiece of the present invention has a thin, nearly flat and small-angle beak, a player holds inside the mouth.

In the woodwind mouthpiece of the present invention, a thickness (T1) of the beak between an upper exterior surface of the beak and a surface of one of the side rail can be in a range from 2 mm to 8 mm (2 mm≤T1≤8 mm). In one aspect of the present invention, the thickness is measured at an interface between the beak and a connection portion connecting the beak and the main body. In another aspect of the present invention, the thickness is measured at a distance from the tip rail to 80% of a distance between the tip rail and a position of the interface at the transitional region between the beak and the connection portion to the main body. Herein, the thickness is measured at the closest one of the positions of the break-point of one of the side rails and the interface position. The interface position is where the upper exterior surface of the beak rises and meets with the upper exterior surface of the connection portion to form a maximum curvature.

In the present invention, the thickness (T1) may range from 2 mm to 6 mm (2 mm≤T1≤6 mm) for soprano saxophone. The thickness (T1) may range from 2 mm to 7 mm (2 mm≤T1≤7 mm) for alto saxophone. The thickness (T1) may range from 2 mm to 8 mm (2 mm≤T1≤8 mm) for tenor saxophone and baritone saxophone. Preferably, the tip of the beak saxophone mouthpiece has a thickness in a range from 0.5 mm to 2.5 mm (0.5 mm≤T1*a*≤2.5 mm), and this thickness may be equivalent to the beak wall thickness. However, the present invention is not limited thereto. The beak tip thickness scales up with decreasing mechanical strength of the material for making the mouthpiece. The height of side rail scales up with lowering baffle. Herein, the baffle of the mouthpiece is an area of the beak that the air through a smaller space (like from the inside of player's mouth to the space between reed and baffle) speeds up and lowers the pressure of the air.

With a small angle between the upper exterior surface and the lower surface of the side rails, the distance between the upper exterior surface of the beak and the side rail surface is slightly larger than the tip opening depending on the thickness of the beak. The distance between the reed at rest and the upper exterior surface of the beak increases slowly from the tip to the transitional corner where the upper exterior surface of the beak begins to rise at a much faster rate or a much larger slope than the small-angle beak. In the present invention, the corner can be referred to the interface between the beak and the connecting portion. At the corner, which is near the break-points of side rails within a distance of 0 to 5 mm, the thickness of the beak measured from the upper outer surface to the surface of the side rails is therefore also small. The thickness (T1) at the corner is determined by the wall thickness (T1*a*) of the beak plus the height (T1*b*) of the side rails. The air channel is defined by the inner surface of the reed and the lower interior surface of the beak. For example, for a mouthpiece made of mechanically strong materials such as titanium alloy and other metal alloys, 1 mm thick beak wall suffices. For mouthpiece with a high baffle, the distance between the upper exterior surface of the beak and the lower surface of the side rail is as small as 2-3 mm. Therefore, the total thickness of the beak at the corner can be as small as 3-5 mm. Such a small thickness at the corner near the break-point of the side rails, where the lower lip seals air leakage, causes little deformation of the lip and a player has two lips separate by only 2-5 mm, which is a small lip opening and a comfortable embouchure. A player can play for a long time for high performance. However, the present invention is not limited thereto, and the thickness of the beak wall and the distance between the upper exterior surface of the beak and the lower surface of the side rails can be adjusted according to the needs.

When a small-angle beak with thin corner is sealed by two lips, the mouthpiece can be easily oriented upwards or downwards in a larger range of angles with respect to the head of the player than a traditional mouthpiece with a thick and large-angled beak near the break-point. Therefore, the mouthpiece can be oriented in the optimal way for air to be blown into the tip opening in a more desirable means to achieve the desired sound. The mouthpiece can be turned upwards or downwards freely during playing for desirable sound characteristics. Air that flows along the inner wall of the thin beak spreads out while it enters the chamber. The air jet formed by the high-baffle thin-beak mouthpiece with a wall of as thin as 1 mm (but the present invention is not limited thereto) excites vibration of the reed, the read table and the body of the mouthpiece. By proper design and optimization of the structure of a mouthpiece, additional modes of vibration and harmonics are generated to produce appealing sounds, which are impossible by traditional mouthpieces.

In the woodwind mouthpiece of the present invention, the reed table may have a portion ranging from 10% to 90% in a total table area being detached and suspended from the main body. In other word, an area of the reed table, which is attached to the main body at one end closest to the tip of the beak, between 10% and 90% of the total table area of the reed table may be suspending from the main body. In the present invention, more than 10% (for example, 10%, 20% 30%, 40%, 50%, 60%, 70%, 80% or 90%) of the total table area of the reed table is not attached to the main body but is suspending in air from the main body or is supported at the farthest end of the table from the beak by a structure, which can be made of rigid or elastic materials. The reed table can vibrate with respect to the main body. The amplitude of vibration and the spring constant of the elastic structure are selected to provide unique and improved performance according to the wish of a player. In addition, the reed table may further connect to the reed rail surrounding the beak, and an opening window can be formed between the hollow chamber inside the main body and the reed, which is pressed against the side rails and the tip rail.

In the woodwind mouthpiece of the present invention, part of the two lateral sides of the reed table parallel to the longitudinal axis of the main body is suspending from the main body. Thus, gaps form between the main body of the mouthpiece and the two lateral sides of the reed table. These gaps allow a slide-in ligature to be applied for tightening a reed to the table. The suspended table can vibrate in its own new modes, which are coupled with vibration modes of the reed to provide sound of rich harmonics and unique and desirable sound color. In addition, a width between the two lateral sides can be smaller than an outer diameter of the main body.

A ligature is applied to hold a reed tightly to the reed table of the mouthpiece. The reed becomes integrated with the reed table. For traditional mouthpieces, almost the whole reed table is fixed to the main body of a mouthpiece. Although some specially designed ligature applies forces only at selected points on the reed, the freedom of vibration of the reed is much restrictive. Therefore, there is little or no relative motion between the root portion of the reed and the mouthpiece. Only the thinner part of the reed near the tip vibrates along with the air pressure. When the reed vibrates, the elasticity of the reed table and how the reed is tightened against the reed table by a ligature affect the reed vibration. If the reed table is also allowed to vibrate in a different frequency from how the reed vibrates, even more vibrational modes of the reed are produced, and a unique and appealing tone color becomes possible.

In addition, traditional mouthpieces include reed tables, which are made by cutting a flat surface on the outer surface of the main body of the mouthpiece. In this case, the reed table can't bend or vibrate independent of the mouthpiece body. In the present invention, the reed table can be partially suspending to allow it to vibrate with respect to the main body of the mouthpiece. The vibration modes and amplitude of vibration of the reed table can be controlled and restricted by choosing the elasticity of the reed table, the elastic properties of the table support, and gap spacing for the reed table to move. The vibration of the reed table is coupled with the reed vibration to produce a wide spectrum of vibration modes and thus a sound of rich characteristics.

On the reed table there can be two reed guides. The distance between these two reed guides matches the width of the reed. When the reed is inserted between the reed guides, the reed is aligned with two side rails. The reed guides further prevent the reed from shifting sideway due to vibration of the reed and vibration of the partially suspended reed table.

In the woodwind mouthpiece of the present invention, at least one element may be disposed in the gap between the reed table and the main body.

In the woodwind mouthpiece of the present invention, the at least one element may be movable in the gap for adjusting an angle of a surface of the reed table with respect to the main body.

In the woodwind mouthpiece of the present invention, the at least one element may be disposed into the gap between the reed table and the main body. Alternatively, the at least one element may be attached to one of the reed table and the main body or attached to both the reed table and the main body.

In the woodwind mouthpiece of the present invention, the disposed element in the gap between the reed table and the main body may be made of an elastic material, such as an elastic spring, a soft polymer block, a cork block, a cured silicone block or a combination thereof. These are examples but not exclusive. Technical persons in the field of arts know how to select other elastic materials to implement the same function. In addition, a thickness or a height of the element in its relaxed state may be adjustable between 80% and 120% or between 100% and 140% of a distance of the gap when the reed table and the main body are at rest. Because of the elasticity of the elastic material, the element can fit the gap well and the thickness of the height of the element may be changed when the reed table, which is partially suspending from the main body, vibrates. In addition, the height of the attaching element can be adjusted and the reed table can be tilted at a selected angle with respect to a longitudinal axis of the main body.

Alternatively, the element may be a threaded element including a bolt or a screw with a matching nut attached to one of the reed table and the main body for adjusting the length of the bolt or screw in the gap.

The disposition of the element is described below in detail.

In the woodwind mouthpiece of the present invention, the reed table suspended from the main body can be attached to the main body via an attaching element. For example, the attaching element is disposed on a part of a surface of the reed table facing to the main body. In one aspect of the present invention, the attaching element can be disposed at the center of the surface of the reed table facing to the main body. In another aspect of the present invention, a portion of the gap can be filled with elastic materials such as silicone. The selection of elastic materials determines the spring constant of the reed table and thus the vibration modes and amplitude of vibration of the reed table and the characteristics of sound it generates. Further in another aspect of the present invention, the elastic material can fill the gap partially leaving with a small gap that limits the amplitude of the vibration of the reed table. In another aspect of the present invention, the attaching element can be a threaded bolt or screw-like mechanism, which allows the gap between the reed table and the main body to be adjusted by turning the bolt or screw clockwise or counterclockwise. When the gap at the farthest end from the beak increases, the reed table bends and the tip of the reed becomes closer to the tip rail. As a result, the tip opening decreases. When the gap decreases, both the tip opening and the lay length, that is the distance between the tip and the break-point on the side rails increases. The sound generated by the mouthpieces can thus be selected according to the wish of a player. In another aspect of the present invention, the attaching element can be disposed on a side of the reed table farthest from the beak. Herein, the attaching element can be integrated with the reed table and the main body. In further another aspect of the present invention, a side of the reed table closest to the beak can be attached to the main body, and another side of the reed table farthest from the beak is suspended from the main body from the main body to form a gap between the reed table and the main body. In further another aspect of the present invention, the reed table is connected to the main body only via one end of the reed table closest to the beak and almost the whole surface of the reed table is suspended from the main body. To maximize the vibration of the reed table, a slide-in ligature instead of an around-the-body ligature can be fixed to two lateral gaps below the suspending reed table.

In the present invention, the woodwind mouthpiece with a reed table, of which 100% of the table area, except fixing to the main body of the woodwind mouthpiece at the upper part of the reed table near the window shill above the chamber of the mouthpiece, can be suspended. The nearly fully suspended reed table with a slide-in ligature to fix a reed may vibrate almost freely. The extent of vibration and the amplitude of vibration are controlled to produce desired and unique sound. When a reed is fixed to the reed table, the reed couples its own vibration with the reed table vibration to create unique and beneficial harmonics. The length, width, and thickness of the reed table and the elastic properties of the reed table including an optional support at the far end of the reed table from the beak or an elastic support for the whole or part of the length of the reed table determine the fundamental frequency of the reed table vibration. There are many more applications of the gap spacing between the suspending reed table and the main body. For example, the gap spacing between the suspended reed table and the main body of the woodwind mouthpiece can be used for embedded microphone, which picks up sound being generated by the woodwind mouthpiece and feeds it to an amplifier. The gap spacing between the suspended reed table and the main body can be used to hold a voice actuated light emitting diode, which lights up by matching sound generated by the mouthpiece. The gap spacing can also be filled fully or partially with elastic materials such as silicone. Elastic filler allows the reed table to vibrate but limits the amplitude of vibration to a desired magnitude. When the amplitude of vibration of the reed table is too large, the changes in the tip opening and the lay length, which is the distance between the tip and the break-point, is too large for the subsequent note to be accurately produced. By controlling the amplitude of vibration of the reed table, this is prevented.

Furthermore, in the present invention, when almost the whole surface of the reed table is suspended from the main body, a supporting element can be disposed in the gap between the reed table and the main body. Herein, the supporting element can be a rigid or an elastic element. The size of the supporting element provides the option of including the function of being able to adjust the tilting of the reed table and thus the tip opening. For traditional mouthpieces, the tip opening is fixed. Re-facing of the woodwind mouthpiece is necessary to change the tip opening. The elastic property of the supporting element can control the amplitude of vibration and the fundamental frequency of vibration of the reed table and the coupled vibration of the reed.

In the woodwind mouthpiece of the present invention, a slope ($\theta 2$) of a connecting portion from the upper exterior surface of the beak to a upper exterior surface of the main body may range between 10 degrees and 90 degree ($10° \leq \theta 2 \leq 90°$). Preferably, the slop can be in a range from 30 degrees to 60 degrees ($30° \leq \theta 2 \leq 60°$). Herein, the slope of the connecting portion can be defined by an angle included between the upper exterior surface of the connecting portion and an extension surface of the upper exterior surface of the beak. In the present invention, the slope of the connecting portion increases at a much faster rate at the transition point and then decreases to zero degree in parallel to the upper exterior surface of the main body. The rapid rising in height and angle of the upper exterior surface provides a convenient physical alignment guide for a player to optimize the embouchure by placing the lips and teeth at desired optimal positions. After the small-angle beak ends, the upper outer surface of the connecting portion rises at a slope of 30-90 degrees. The corner formed between the connecting portion and the beak is easily felt by a player to serve as an alignment mark for precise control of the embouchure by positioning lips at the optimal location with respect to the break-points of the side rails of a mouthpiece.

It should be noted that the upper exterior surface of a beak can also be concave, i.e. the beak exhibits a negative slope near the tip and then changes to a positive and yet small slope angle until it reach the region near the break-point. This occurs especially for the woodwind mouthpiece with a large tip opening and a high baffle or a small height of side rails. In this case, the distance between the upper exterior surface of the tip of the beak to the reed at rest is larger due to the larger tip opening. However, the tip opening is typically slightly larger than 2 mm or smaller for alto and soprano saxophone mouthpieces and slightly larger than 3 mm or smaller for tenor and baritone saxophone mouthpieces. The beak is thin compared to traditional mouthpiece of the same tip opening. Therefore, with a concave upper exterior surface of the beak, the distance between the upper exterior surface of the beak and the lower surface of the reed at rest may be smaller than the distance at the tip. From the player's point of view, the distance is the thickness of the beak the play feels by the lips and upper teeth and the separation of two lips a play needs to maintain during a long-period performance. This results in a concave beak or a beak with negative slope for front part of the beak. Because the front portion of the beak is inside the mouth of a player, the player does not feel any difference about the negative slope of the front part of the beak. It does not affect adversely how the player feels and performs.

In the present invention, the woodwind mouthpiece can be scaled in x, y, and z dimensions for uses as mouthpieces of sopranino, soprano, alto, tenor, and baritone saxophone. In addition, other types of woodwind mouthpieces using single reed, including clarinet mouthpieces, are also included in this invention, as long as it contains one or more featured structures of the woodwind mouthpiece of the present invention.

In the woodwind mouthpiece of the present invention, the main body, the beak and the connection portion can be integrated into one piece. In addition, the main body, the beak, the connection portion and the reed table can be integrated into one piece. Furthermore, the main body, the beak, the connection portion, the reed table and the attaching element are integrated into one piece.

Moreover, the woodwind mouthpiece of the present invention can be formed by, for example, casting, direct machining, injection molding, glass working, ceramic molding, or 3-D printing. In one embodiment of the present, the woodwind mouthpiece can be made of the plastic or the composite, which may be a plastic composite, which has a tilted plastic wire texture. Herein, a tilted angle of the tilted plastic wire texture of the plastic or the plastic composite can be produced by fused filament fabrication and ranges from 20 degrees to 70 degrees with respect to a central line in a longitudinal direction of the main body. The strength of an extruded plastic wire is stronger than the bonding or fusion of two wires side by side. A tilted fused plastic wire texture for a mouthpiece makes the mouthpiece mechanically stronger and will be more difficult to break along a plane perpendicular to the longitudinal axis of the mouthpiece. When a mouthpiece is used, the applied force usually focuses in a direction perpendicular to the longitudinal axis of the mouthpiece.

Other novel features of the invention will become more apparent from the following detailed description when taken in conjunction with the accompanying drawings.

DETAILED DESCRIPTION OF EMBODIMENT

Figure 1:
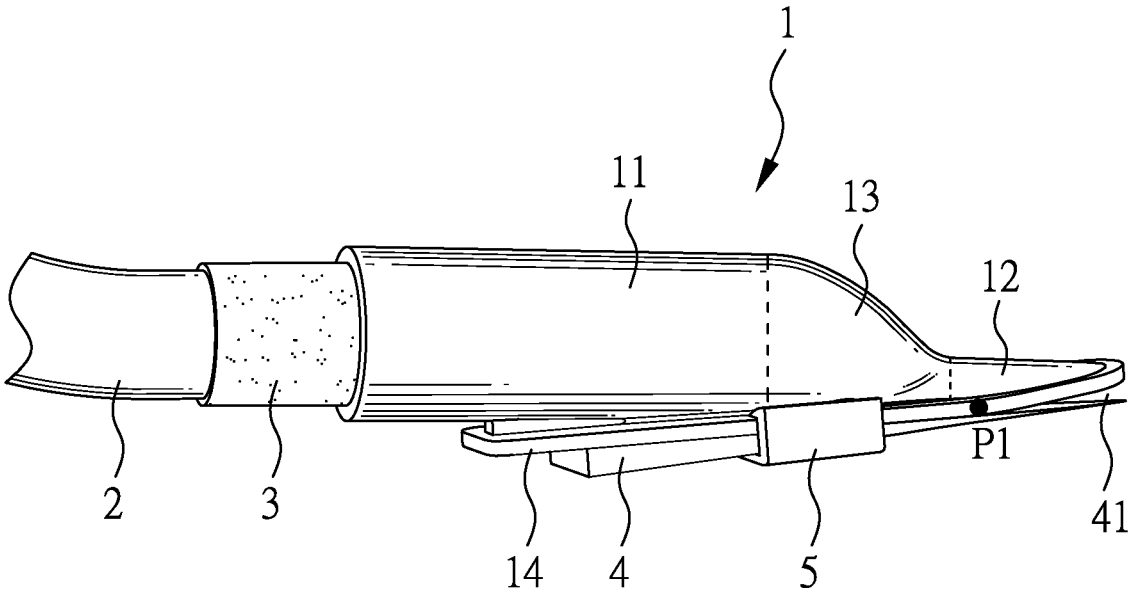
FIG. 1 is a schematic view showing a woodwind mouthpiece mounted on a neck of a saxophone according to Example 1 of the present invention.

Different embodiments of the present invention are provided in the following description. These embodiments are meant to explain the technical content of the present invention, but not meant to limit the scope of the present invention. A feature described in an embodiment may be applied to other embodiments by suitable modification, substitution, combination, or separation.

It should be noted that, in the present specification, when a component is described to comprise an element, it means that the component may comprise one or more of the elements, and it does not mean that the component has only one of the element, except otherwise specified.

Moreover, in the present specification, the ordinal numbers, such as "first" or "second", are used to distinguish a plurality of elements having the same name, and it does not means that there is essentially a level, a rank, an executing order, or an manufacturing order among the elements, except otherwise specified. A "first" element and a "second" element may exist together in the same component, or alternatively, they may exist in different components, respectively. The existence of an element described by a greater ordinal number does not essentially means the existence of another element described by a smaller ordinal number.

In the present specification, except otherwise specified, the feature A "or" or "and/or" the feature B means the existence of the feature A, the existence of the feature B, or the existence of both the features A and B. The feature A "and" the feature B means the existence of both the features A and B. The term "comprise(s)", "comprising", "include(s)", "including", "have", "has" and "having" means "comprise(s)/comprising but is/are/being not limited to".

Moreover, in the present specification, the terms, such as "top", "upper", "bottom", "front", "back", or "middle", as well as the terms, such as "on", "above", "over", "under", "below", or "between", are used to describe the relative positions among a plurality of elements, and the described relative positions may be interpreted to include their translation, rotation, or reflection.

Furthermore, the terms recited in the specification and the claims such as "above", "over", or "on" are intended not only directly contact with the other element, but also intended indirectly contact with the other element. Similarly, the terms recited in the specification and the claims such as "below", or "under" are intended not only directly contact with the other element but also intended indirectly contact with the other element.

Furthermore, the terms recited in the specification and the claims such as "connect" is intended not only directly connect with other element, but also intended indirectly connect with other element.

Furthermore, when a value is in a range from a first value to a second value, the value may be the first value, the second value, or another value between the first value and the second value.

Moreover, in the present specification, a value may be interpreted to cover a range within ±20% of the value, and in particular, a range within ±10%, ±5%, ±3%, ±2%, ±1% or ±0.5% of the value, except otherwise specified. The value provided in the present specification is an approximate value, which means the meaning "about" is also included in the present invention without specifically specifying "about".

In the present specification, except otherwise specified, the terms (including technical and scientific terms) used herein have the meanings generally known by a person skilled in the art. It should be noted that, except otherwise specified in the embodiments of the present invention, these terms (for example, the terms defined in the generally used dictionary) should have the meanings identical to those known in the art, the background of the present invention or the context of the present specification, and should not be read by an ideal or over-formal way.

Example 1

FIG. 1 is a schematic view showing a woodwind mouthpiece mounted on a neck of a saxophone of the present example. In the present example, the woodwind mouthpiece is made by 3-D printing using PLA plastic. Herein, the woodwind mouthpiece has a tilted plastic wire texture, and a tilted angle of the tilted plastic wire texture is produced by fused filament fabrication and ranges from 20 degrees to 70 degrees with respect to a central line in a longitudinal direction of the main body. However, the material of the woodwind mouthpiece is not limited thereto.

As shown in FIG. 1, the woodwind mouthpiece 1 is mounted on the neck 2 of a woodwind musical instrument, which is a saxophone in the present example, including a soft cork 3 around the neck 2. A reed 4 held onto a reed table 14 of the woodwind mouthpiece 1, and held by a ligature 5 to the reed table 14. Different reeds ranging from cane, metal, and plastic reeds can be used. Many different ligatures can replace the one shown in FIG. 1 although the one shown in FIG. 1 is the most compact and appealing.

Figure 2:
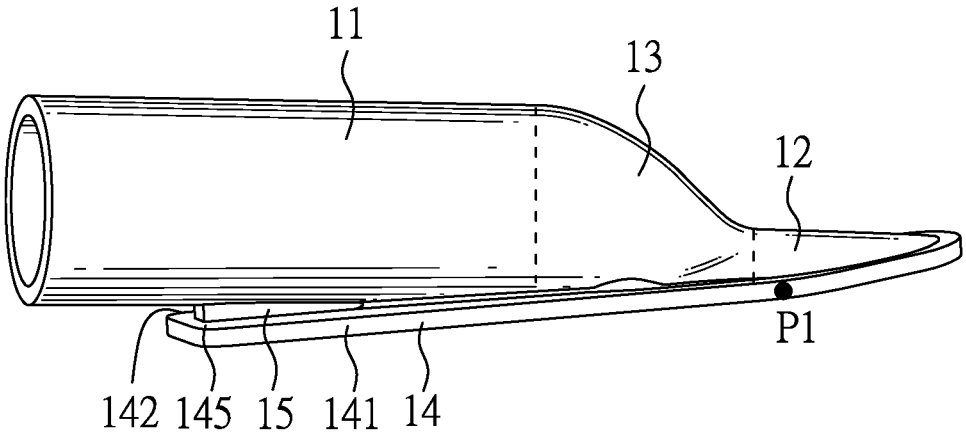
FIG. 2 is a schematic view showing a woodwind mouthpiece according to Example 1 of the present invention.
Figure 3:
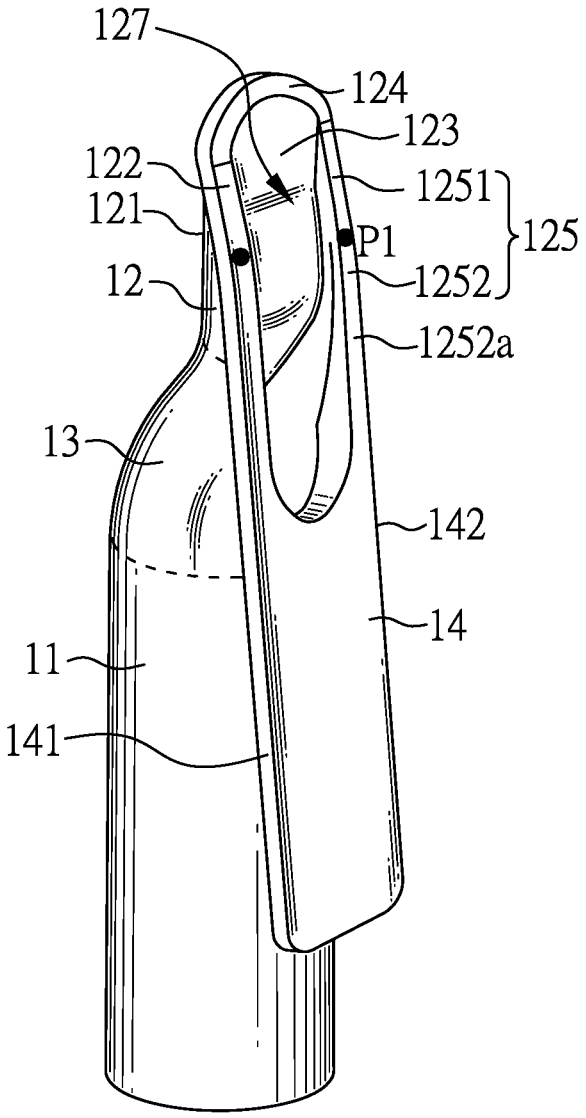
FIG. 3 is another schematic view showing a woodwind mouthpiece according to Example 1 of the present invention.
Figure 4:
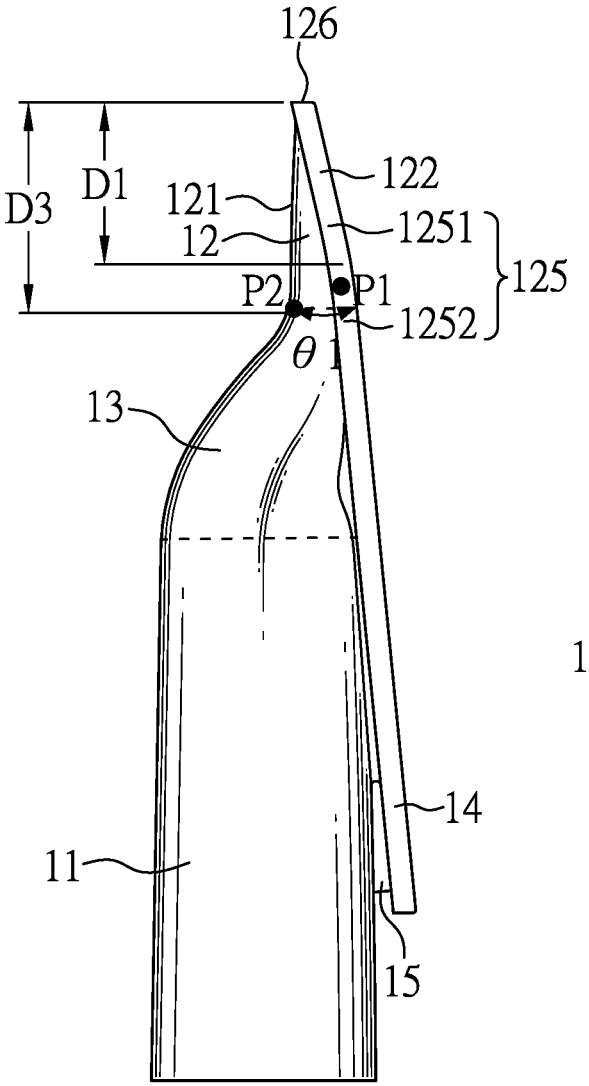
FIG. 4 is a side view showing a woodwind mouthpiece according to Example 1 of the present invention.
Figure 5:
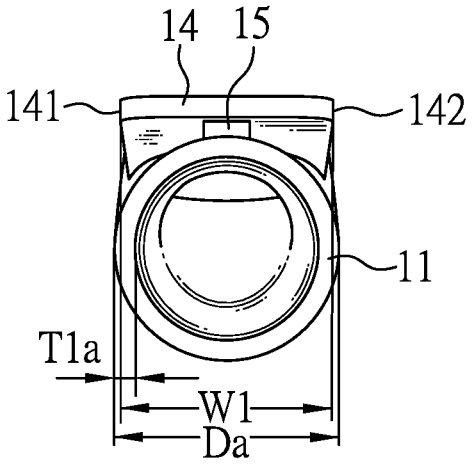
FIG. 5 is a bottom view showing a woodwind mouthpiece according to Example 1 of the present invention.
Figure 6:
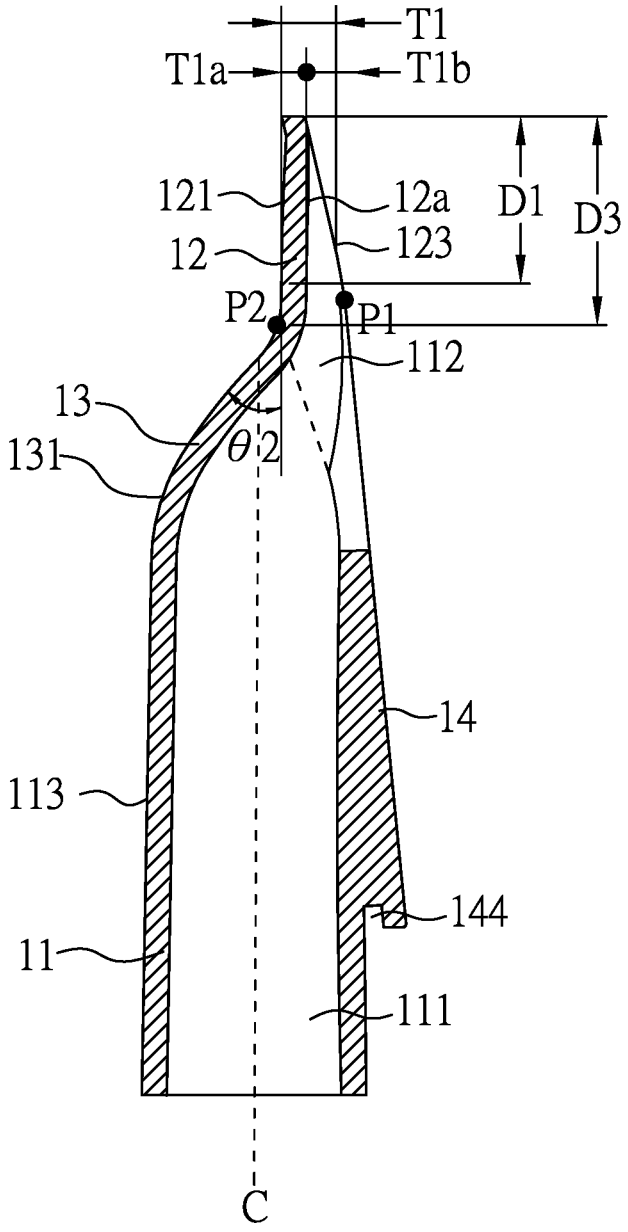
FIG. 6 is a cross-sectional view showing a woodwind mouthpiece according to Example 1 of the present invention.

The detail structure of the woodwind mouthpiece 1 of the present example is shown in FIG. 2 to FIG. 6. FIG. 2 and FIG. 3 are different schematic views of the woodwind mouthpiece of the present example; FIG. 4 is a side view of the woodwind mouthpiece of the present example; FIG. 5 is a bottom view of the woodwind mouthpiece of the present example; and FIG. 6 is a cross-sectional view of the woodwind mouthpiece of the present example.

Referring to FIG. 2 to FIG. 6, the woodwind mouthpiece of the present example comprises: a main body 11 having an elongated streamlined shape; a hollow chamber 112 and a bore 111 inside the main body 11; a reed table 14 on one side of the main body 11 and partially suspended from the main body 11; a beak 12 on an opposite side to the reed table 14 on the main body 11; a reed rail (including side rails 125 and a tip rail 124) surrounding the beak 12 and connecting to two lateral sides of the reed table 14 to form an opening window 127 (as shown in FIG. 3) between a reed 4 and the hollow chamber 112 and 123 inside the main body 11; and a tip opening 41 disposed between the reed rail at a tip 124 of the beak 12 and virtual surface extending from a surface 143 of the reed table 14. In the present example, the woodwind mouthpiece has a thin, nearly flat, small-angle beak 12.

In the present example, the reed rail comprises a tip rail 124 and side rails 125 connecting to the tip rail 124, and a lay length is a distance between the tip rail 124 and a break-point P1 of one of the side rails 125. Herein, a front section of the beak 12 equal to 80% of a distance D3 between the tip rail 124 and an interface along a central line C in a longitudinal direction of the main body 11 has a beak wall thickness Ta ranging from 0.5 mm to 2.5 mm (0.5 mm≤T1*a*≤2.5 mm), wherein the interface is between the beak 12 and a connection portion 13 connecting the beak 12 and the main body 11, and the front section of the beak 12 is a region having a length D1 equal to 80% of the distance D3.

In the present example, the beak 12 comprises an upper exterior surface 121 and the side rails 125 have lower surfaces 1252*a*. An angle θ1 included between the upper exterior surface 121 and the surface 1252*a* of the side rails 122 with respect to the tip of the beak 12 and measured at one of two positions at a smaller distance to the tip 126, wherein two positions are the break-point and the interface between the beak 12 and the connection portion 13. The interface between the beak 12 and the connection portion 13 is defined as the transitional point P2 with the maximum curvature of the upper exterior surface of the mouthpiece formed by the turning upwards of the upper exterior surface of the beak 12 to meet with the connection portion 13. The interface is close to the break-point with a distance between the interface and the break-point being less than 5 mm. θ1 can be ranged from 5 degree to 20 degrees, for example greater than 5 degrees but less than or equal to 20 degrees (5°<θ1≤20°). Alternatively, the angle θ1 can be 5°<θ1≤15°, 5°<θ1≤10°, 5°≤θ1≤15° or 5°≤θ1≤10°, depending upon the mouthpiece design.

In the present example, the reed rail comprises side rails 125 and a tip rail 124 connecting to the side rails 125. Herein, the lower surface 12*a* of the beak 12 comprises the inner surface of the air channel, a tip rail 124 and at least parts of side rails 125 which are what the reed 4 beats against, and two ends of the tip rail 124 respectively connects to one end of the side rails 125. The side rails 125 respectively comprise a first part 1251 and a second part 1252, wherein the reed 4 is in touch with the second parts 1252 of the side rails 125 and separates from the first part 1251 of the side rails 125, and the position of the reed 4 separating from the side rails 125 is the break-point P, which is located between the first parts 1251 and the second parts 1252 of the side rails 125. Herein, the angle θ1 is measured from the tip 126 of the beak 12 to the interface between the beak 12 and the connection portion 13. It should be noted that the break-point P1 is close to the interface between the beak 12 and the connecting portion 13, but does not necessarily aligned with the interface between the beak 12 and the connecting portion 13. In some cases, the break-point P1 can be farther than the interface measured from the tip 126.

In the present example, a thickness T1 of a portion of the beak 12 between the upper exterior surface 121 of the beak 12 and the surface 1252*a* of the side rails 125 at the interface between the beak 12 and the connecting portion 13 can be in a range from 2 mm to 8 mm (2 mm≤T1≤8 mm). Alternatively, the thickness T1 can be in a range from 2 mm to 5 mm (2 mm≤T1≤5 mm). Further alternatively, the thickness T1 can be in a range from 3 mm to 4 mm (3 mm≤T1≤4 mm). In addition, the tip 126 of the beak 12 may have a thickness T1 in a range from 0.5 mm to 2.5 mm (0.5 mm≤T1≤2.5 mm). Herein, the thickness of the tip 126 of the beak 12 may be equivalent or equal to the beak wall thickness of the beak 12. Herein, the thickness T1 at near to the connecting portion 13 can be determined by the thickness T1*a* of the wall of the beak 12 plus the height T1*b* of the air channel defined by the inner surface 12*a* of the beak 12 and the lower surface 1252*a* of the side rails 125.

Herein, the thickness T1 of the beak 12 between the upper exterior surface 121 of the beak 12 and the surface 1252*a* of the side rails 125 can be measured at the interface. In the present example, the interface is near the break-points P1 of the side rails 125. Thus, a player can easily align the upper lip with the break-point P1 by touch the upper lip with the fast-rising slope at the end of the thin beak 12. In the present example, a slope θ2 of the front portion near the beak of the connecting portion 13 from the upper exterior surface 121 of the beak 12 to an exterior surface 113 of the main body 11 may range between 0 degrees and 90 degrees (0°≤θ2≤90°). In particular, the slope θ2 can be in a range from 0 degrees to 60 degrees (0°≤θ2≤60°). Herein, the slope θ2 of the connecting portion 13 can be defined by an angle included between the upper exterior surface 131 of the connecting portion 13 and an extension surface of the upper exterior surface 121 of the beak 12.

Thus, one feature of the woodwind mouthpiece of the present example is the thin and nearly flat beak 12, which increases in thickness between the side rails and the upper exterior surface rapidly near the interface. The front part of the side rails 125 (i.e. the first parts 1251 of the side rails 125) close to the tip 126 is curved. The rear part of the side rails 125 (i.e. the second parts 1252 of the side rails 125) behind the break-point P1 is straight and in-line with the reed table 14. Thus, when the reed 4 is fixed to the reed table 14, the reed 4 sits on the reed table 14 and the rear part of the side rails 125 (i.e. the second parts 1252 of the side rails 125) tightly so that there is no air leakage from the rear part of the reed 4.

In the present example, the woodwind mouthpiece further comprises: a reed table 14 on one side of the main body 11 and connecting to the reed rail surrounding the beak 12 (in particular, the side rails 125), wherein the opening window 127 (as shown in FIG. 3) is formed between the hollow chamber 112 and 123 inside the beak 12 and the connection portion 13 with the reed 4 at still. Herein, a side of the reed table 14 closest to the beak 12 is attached to the main body 11, and another side of 10% to 90% of a total area of the reed table 14 farthest from the reed table 14 of the beak 12 is suspended from the main body 11 to form a gap 144 between the reed table 14 and the main body 1*l*. Thus, an area of the reed table 14 which is attached to the main body 11 is between 10% and 90% of the total table area of the reed table 14. In particular, two lateral sides 141, 142 of the reed table 14 are suspended from the main body 11, and the two lateral sides 141, 142 are sides extending along an extension direction of the main body 11. Herein, a width W1 between the two lateral sides is smaller than an outer diameter Da of the main body 11.

In the present example, an element (i.e. an attaching element 15) is disposed in the gap 144 between the reed table 14 and the main body 11. In addition, the element (i.e. an attaching element 15) is attached to one of or both the reed table 14 and the main body 11. In particular, the reed table 14 suspended from the main body 11 can be attached to the main body 11 via an attaching element 15, wherein the attaching element 15 is disposed on a part of a surface 145 of the reed table 14 facing to the main body 11. Herein, the main body 11, the beak 12, the connecting portion 13, the attaching element 15 are integrated into one piece.

Thus, in the woodwind mouthpiece of the present example, both lateral sides 141, 142 of the reed table 14 are suspended, and a slide-in ligature 5 like the one shown in FIG. 1 can clamp on the suspended sides 141, 142 of the reed table 14.

In the present example, the partially suspended reed table 14 has more than half of the reed table 14 being detached from the main body 11 of the woodwind mouthpiece. The partially suspended reed table 14 can vibrate. Coupled vibration of the reed table 14 and the reed 4 generate rich harmonics and desirable tone color than traditional mouthpieces. In addition, many kinds of ligatures including all-round ligature and slide-in ligature can be used. The partially suspended reed table 14 allows a variety of slide-in and clamp-on ligatures to be used. A slide-in ligature allows most freedom of vibration of the reed table because the ligature is not attached to the main body.

Thus, another feature of the woodwind mouthpiece of the present example is the partially suspended reed table 14. The portion of the reed table 14, which is not fixed to the main body 11 of the woodwind mouthpiece can vibrate. The vibration of the reed table 14 is coupled with the vibration of the reed 4 to create unique harmonics and tone colors.

Example 2

Figure 7:
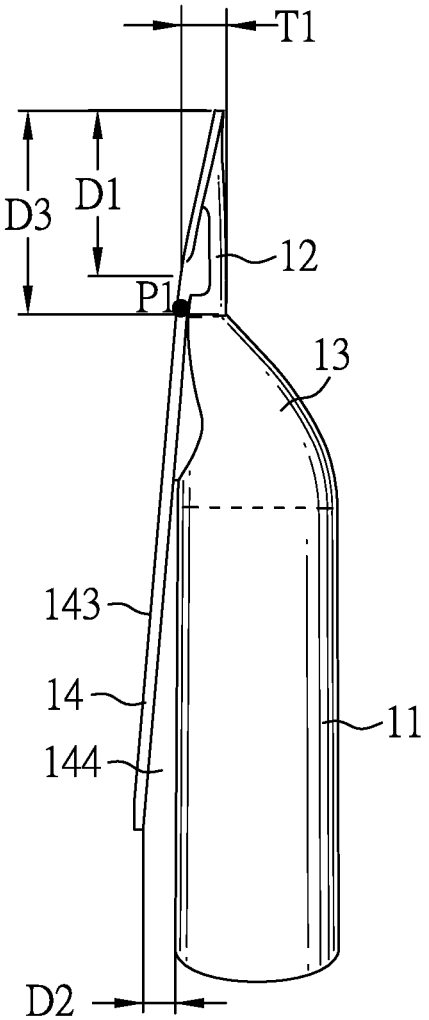
FIG. 7 is a side view showing a woodwind mouthpiece according to Example 2 of the present invention.
Figure 8:
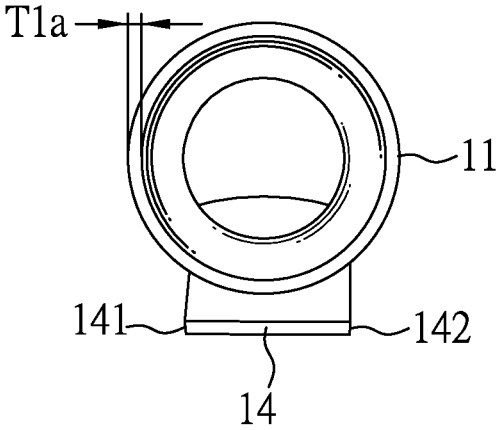
FIG. 8 is a bottom view showing a woodwind mouthpiece according to Example 2 of the present invention.
Figure 9A:
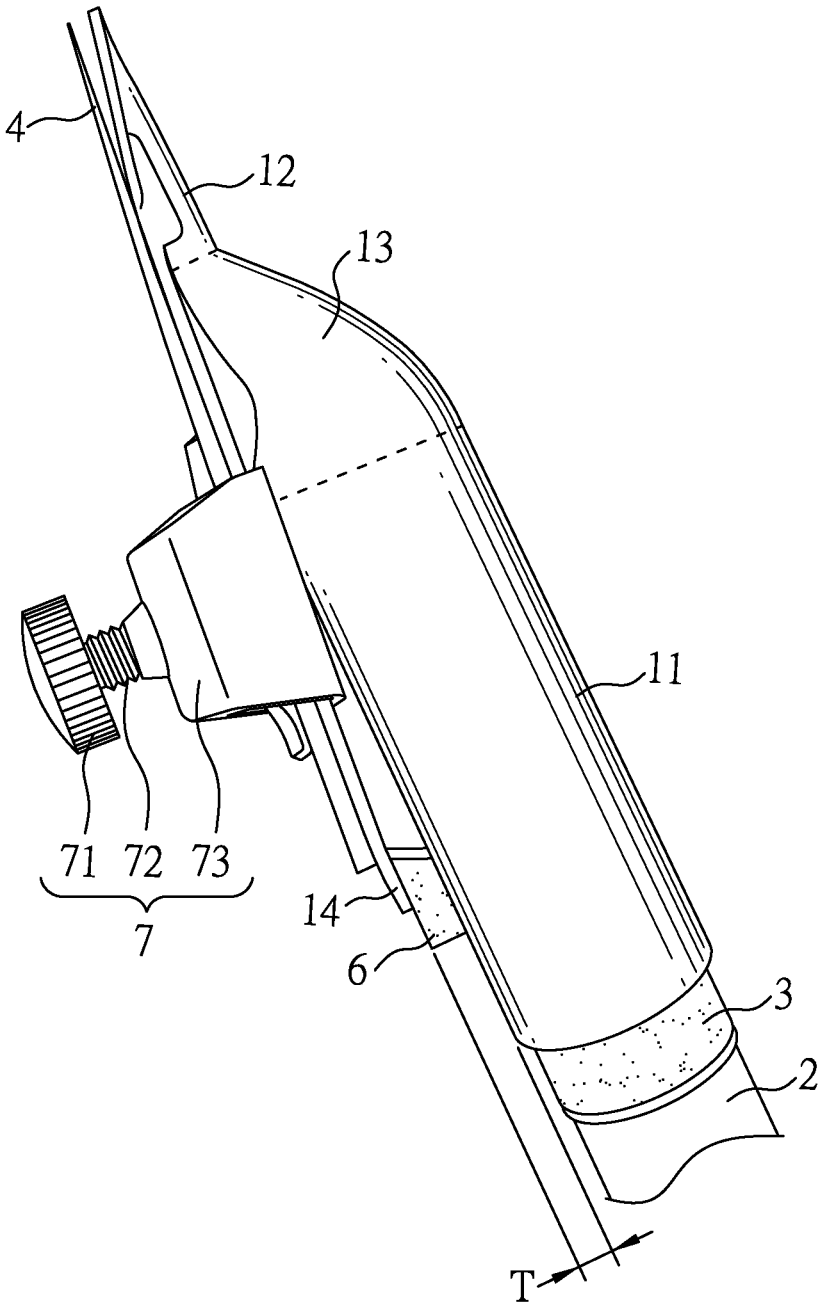
FIG. 9A and FIG. 9B are schematic views showing a woodwind mouthpiece mounted on a neck of a saxophone according to two aspects of Example 2 of the present invention.
Figure 9B:
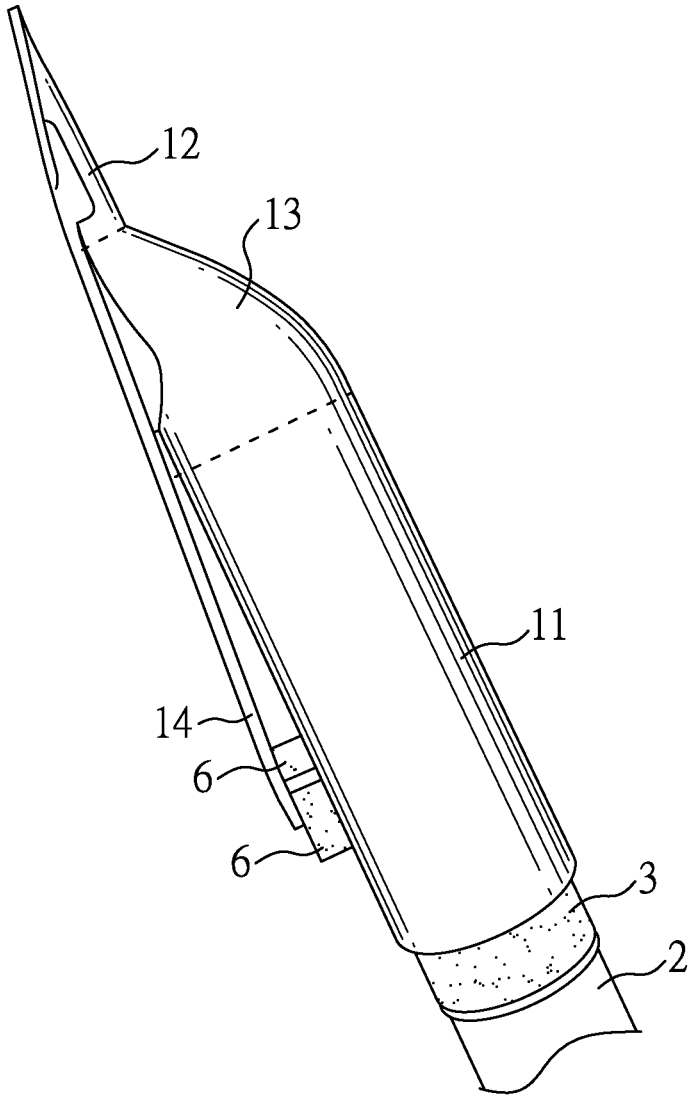

FIG. 7 is a side view of the woodwind mouthpiece of the present example; FIG. 8 is a bottom view of the woodwind mouthpiece of the present example; and FIG. 9A and FIG. 9B are schematic views showing the woodwind mouthpiece of the present example mounted on the neck of the saxophone in different aspects. The woodwind mouthpiece of the present example is similar to that shown in Example 1, except for the following differences.

Referring to FIG. 7 to FIG. 9, in the present example, the woodwind mouthpiece is made by 3-D printing using strong metals like titanium or alloy thereof, aluminum or alloy thereof, stainless steel or strong plastics like PEEK or carbon-fiber reinforced plastic. For example, the woodwind mouthpiece of the present example is a 3-D printed titanium alloy mouthpiece, and the thickness T1*a* of the wall can be as thin as 1 mm or smaller. In particular, all walls of the mouthpiece including those for the main body 11, the beak 12, the connecting portion 13 and the reed table 14 are ultra-thin whenever it is desirable.

In addition, in the present example, the reed table 14 is totally suspended from the main body 11 to form a gap between the reed table 14 and the main body 11 except a portion on the beak side of the reed table 14. In particular, a side of the reed table 14 closest to the beak 12 is attached to the main body 11, and another side of the reed table 14 farthest from the beak 12 is suspended from the main body 11 to form a gap 144 between the reed table 14 and the main body 11.

Because of the strong mechanical strength of titanium alloy, the woodwind mouthpiece with the ultra-thin walls is stable and produces unique and pleasing sounds. The beak 12 which a player holds with two lips and the upper teeth is only 2-4 mm in thickness T1 for high baffle mouthpiece. The player does not feel tiresome because the player's mouth remains nearly as close as when it is shut and resting. The ultra-thin but mechanically strong reed table 14 provides desired elasticity and quick responses when it vibrates along with the reed 4 (as shown in FIG. 1). Additional support to the reed 4 is optional but not needed.

In some cases, a supporting element 6 can be selectively disposed in the gap between the reed table 14 and the main body 11. For example, as shown in FIG. 9A, an element (i.e. a supporting element 6) is disposed in the gap 144 between the reed table 14 and the main body 11. Alternatively, as shown in FIG. 9B, a plurality of elements (i.e. supporting elements 6) are disposed in the gap 144 between the reed table 14 and the main body 11. Hereinafter, the features of FIG. 9A are described below, and the features of FIG. 9B are similar to those of FIG. 9A and are not repeated again.

As shown in FIG. 9A, the supporting element 6 can be movable in the gap 144 for adjusting an angle of a surface 143 of the reed table 14 with respect to the main body 11. Herein, the supporting element 6 can be inserted beneath the lower part or the lower end of the reed table 14 in order to reduce the amplitude of vibration of the reed table 14. By pushing the supporting element 6 into the gap 144 between the reed table 14 and the main body 11 of the woodwind mouthpiece, the reed table 14 is tilted and the opening between the reed 4 (as shown in FIG. 1) and the tip rail 124 (as shown in FIG. 3) becomes smaller. Herein, a thickness T or a height of the supporting element 6 can be adjustable between 80% and 120% of a distance D2 of the gap 144 when the reed table 14 and the main body 11 are at rest. It should be noted that, the thickness T of the supporting element 6 shown in FIG. 9A is the thickness of the supporting element 6 when the supporting element 6 is inserted into the gap 144, not the thickness of the supporting element 6 before the supporting element 6 is inserted into the gap 144.

In addition, an element made of a bolt or a screw 15, which permits the adjustment of the length of the bolt or screw between the lower reed table and the main body can be disposed in the gap a mechanism to adjust the length. The change in the length causes the farthest end of the reed table to tilt away or closer to the main body and thus cause the tip opening 41 to be adjusted.

As shown in FIG. 9A, a ligature can be a threaded element 7 including a bolt 71 or a screw 72 with a matching nut 73 attached to the reed table 14, wherein the threaded element 7 can tighten the reed to the reed table. The reed table is free to vibrate except being fixed at the end close to the tip 126 and influenced by the attached element in the gap 144.

In one example, the material of the supporting element 6 can be a cork block. In another example, the material of the supporting element 6 can be a cured silicone block for unique tone color especially for low notes. However, the present invention is not limited thereto, and any elastic material including an elastic spring, a soft polymer block, a cork block, a cured silicone block or a combination thereof can be used as the material of the supporting element 6. In addition, the shape of the supporting element 6 is not limited to this example shown here.

The woodwind mouthpiece with thin walls vibrates with the air oscillation inside the mouthpiece and modify the harmonics contribution or creates additional harmonics. By optimization of the vibration of the reed table 14, innovative mouthpiece with pleasing tone color is made.

The nearly fully suspended reed table 14 has only one end fixed to the main body 11 of the woodwind mouthpiece. The suspended reed table 14 can vibrate. The extension of vibration is determined by the elastic property of the suspended reed table 14 and the coupled force from the vibrating reed 4 (as shown in FIG. 1). Coupled regular vibration of the reed 4 with that of the reed table 14 generates rich harmonics to the oscillation of the air pressure and unique tone color which can't be generated by traditional mouthpieces.

Example 3

Figure 10:
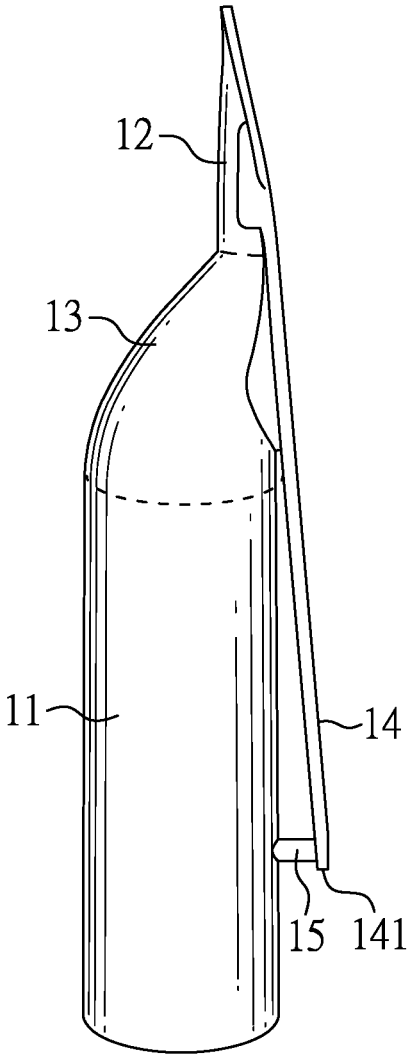
FIG. 10 is a side view showing a woodwind mouthpiece according to Example 3 of the present invention.

FIG. 10 is a side view of the woodwind mouthpiece of the present example. The woodwind mouthpiece of the present example is similar to that shown in Example 2, except for the following differences.

In the present example, the reed table 14 can be attached to the main body 11 via an attaching element 15, and the attaching element 15 is disposed on a side of the reed table 14 farthest from the beak 12. More specifically, the nearly fully suspended reed table 14 has one end fixed to the main body 11 of the woodwind mouthpiece. The other end of the reed table 14 suspended from the main body 11 is attached to the main body 11 by the attaching element 15. Herein, the main body 11, the beak 12, the connecting portion 13, the attaching element 15 are integrated into one piece. The element 15 can be a threaded bolt or a screw, by turning the bolt or screw which both the length of bolt and screw and the gap spacing may be adjusted.

In the present example, most of the reed table 14 remains suspended and can vibrate. The extension of vibration is determined by the elastic property of the suspended reed table 14 and the coupled force from the vibrating reed 4 (as shown in FIG. 1). Coupled regular vibration of the reed 4 with that of the reed table 14 generates rich harmonics to the oscillation of the air pressure and unique tone color which can't be generated by traditional mouthpieces.

Herein, the height of the attaching element 15 can be adjusted and the reed table 14 is tilted at a selected angle with respect to a longitudinal axis of the main body 11. The present example provides one manner for supporting the reed table 14 via the attaching element 15, but the present invention is not limited thereto. The attaching element 15 is attached to both the reed table 14 and the main body 11, and can be a rigid element or an elastic element (for example, an elastic spring, a soft polymer block, a cork block, a cured silicon block or a combination thereof). Therefore, a mouthpiece with adjustable tip opening can be made by this mouthpiece with suspending reed table. When less strong materials than titanium alloy metal and PEEK plastics are used, additional strength enhancement can be applied by increasing the wall thickness of the woodwind mouthpiece in selected areas, which are beneficial to the mechanical strength of the woodwind mouthpiece but of little or no adverse effects on the unique and desirable characteristics of the ultra-thin walled mouthpiece.

Example 4

Figure 11:
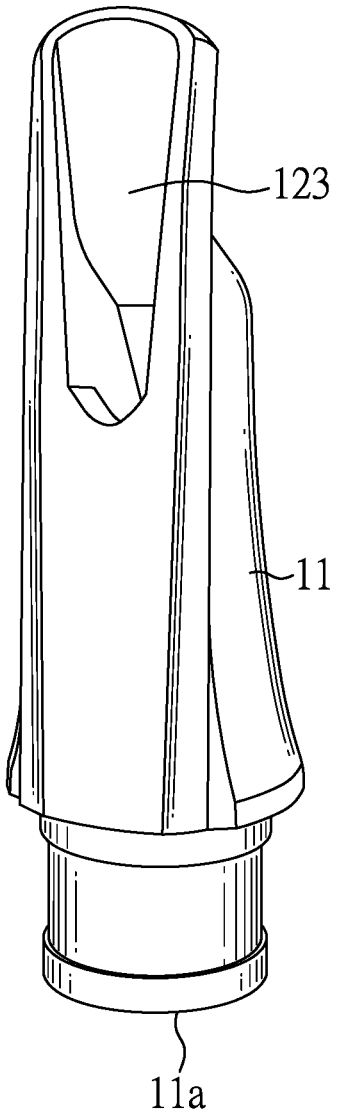
FIG. 11 is a schematic view showing a woodwind mouthpiece according to Example 4 of the present invention.
Figure 12:
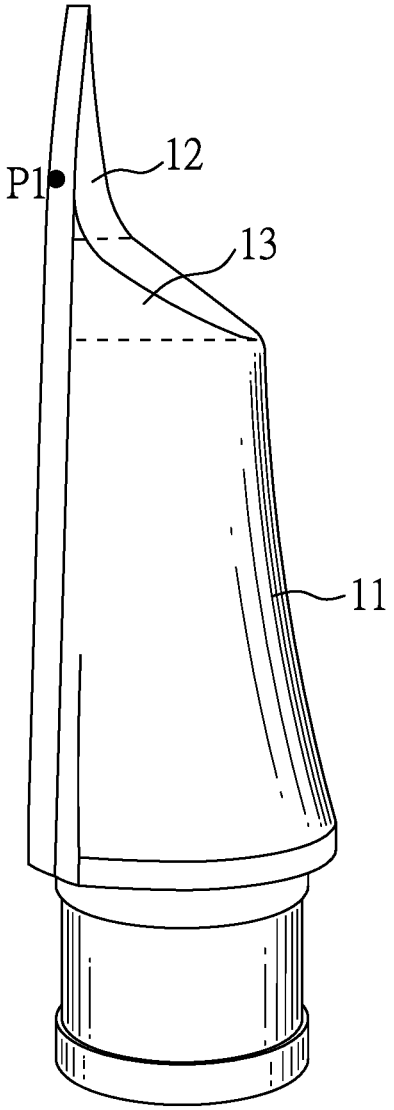
FIG. 12 is a side view showing a woodwind mouthpiece according to Example 4 of the present invention.

FIG. 11 is a schematic view of the woodwind mouthpiece of the present example; FIG. 12 is a side view of the woodwind mouthpiece of the present example; and FIG. 13 is a cross-sectional view of the woodwind mouthpiece of the present example.

Figure 13:
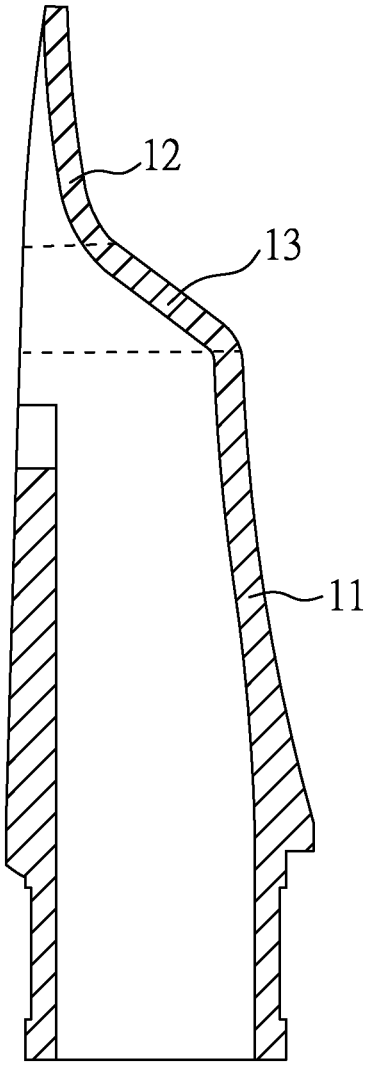
FIG. 13 is a cross-sectional view showing a woodwind mouthpiece according to Example 4 of the present invention.

Referring to FIG. 11 to FIG. 13, in the present example, the woodwind mouthpiece is a clarinet mouthpiece, which incorporates the thin and nearly flat beak as that shown in Example 1. The features of the beak of the woodwind mouthpiece of the present example are similar to that shown in Example 1, and are not repeated again. For a clarinet mouthpiece, the bottom end 11*a* needs to match the diameter of the clarinet barrel, which is much larger than the diameter of a saxophone neck. The thin and nearly flat beak and partially suspended reed table may also apply to the clarinet mouthpiece. The bottom the clarinet mouthpiece must match the diameter of the clarinet barrel. Therefore, the thin and small diameter body does not apply to the bottom 30% of the total length of the clarinet mouthpiece.

Other Examples

In the present invention, the woodwind mouthpiece shown in Examples 1 to 3 can be scaled in x, y, and z dimensions for uses as mouthpieces of sopranino, soprano, alto, tenor, and baritone saxophone.

In the present disclosure, the features in different embodiments of the present disclosure can be mixed to form another embodiment without departing from the spirit and scope of the disclosure as hereinafter claimed.

Although the present disclosure has been explained in relation to its embodiment, it is to be understood that many other possible modifications and variations can be made without departing from the spirit and scope of the disclosure as hereinafter claimed.

What is claimed is:

1. A woodwind mouthpiece, comprising:

a main body having an elongated streamlined shape;

a hollow chamber and a bore inside the main body;

a reed table on one side of the main body and partially suspended from the main body;

a beak on an opposite side to the reed table on the main body;

a reed rail surrounding the beak and connecting to two lateral sides of the reed table to form an opening window between a reed and the hollow chamber inside the main body; and a tip opening disposed between the reed rail at a tip of the beak and a virtual surface extending from a surface of the reed table, wherein the woodwind mouthpiece is made of a plastic, a metal, an alloy, a composite, wood or a combination thereof.

2. The woodwind mouthpiece of claim 1, wherein a side of the reed table closest to the beak is attached to the main body, and another side of 10% to 90% of a total area of the reed table farthest from the tip of the beak is suspended from the main body to form a gap between the reed table and the main body.

3. The woodwind mouthpiece of claim 1, wherein a front section of the beak equal to 80% of a distance between the tip rail and an interface along a central line of the width of the beak in a longitudinal direction of the main body has a beak wall thickness ranging from 0.5 mm to 2.5 mm, wherein the interface is at a border with a maximum curvature between the beak and a connection portion connecting the beak and the main body.

4. The woodwind mouthpiece of claim 1, wherein the reed rail comprises a tip rail and side rails connecting to the tip rail, and a thickness of the beak between an upper exterior surface of the beak and a surface of one of the side rail is in a range from 2 mm to 8 mm; wherein the thickness is measured at an interface at a border a the maximum curvature between the beak and a connection portion connecting the beak and the main body.

5. The woodwind mouthpiece of claim 2, wherein at least one element is disposed in the gap between the reed table and the main body.

6. The woodwind mouthpiece of claim 5, wherein the at least one element is movable in the gap for adjusting an angle of a surface of the reed table with respect to the main body.

7. The woodwind mouthpiece of claim 5, wherein the at least one element is attached to one of the reed table and the main body.

8. The woodwind mouthpiece of claim 5, wherein the at least one element is attached to both the reed table and the main body.

9. The woodwind mouthpiece of claim 5, wherein the at least one element is made of an elastic material.

10. The woodwind mouthpiece of claim 9, wherein the elastic material is an elastic spring, a soft polymer block, a cork block, a cured silicone block or a combination thereof.

11. The woodwind mouthpiece of claim 5, wherein a thickness or a height of the at least one element is adjustable between 80% and 120% of a distance of the gap when the reed table and the main body are at rest.

12. The woodwind mouthpiece of claim 7, wherein the at least one element is a threaded element including a bolt or a screw with a matching nut attached to one of the reed table and the main body.

13. The woodwind mouthpiece of claim 1, wherein the composite is a plastic composite, the woodwind mouthpiece is made of the plastic or the plastic composites, which has a tilted wire texture of the plastic or the plastic composites.

14. The woodwind mouthpiece of claim 13, wherein a tilted angle of the tilted wire texture of the plastic or the plastic composite is produced by fused filament fabrication and ranges from 20 degrees to 70 degrees with respect to a central line in a longitudinal direction of the main body.

* * * * *